United States Patent [19]

Seaquist et al.

[11] Patent Number: 4,735,584

[45] Date of Patent: Apr. 5, 1988

[54] LOW VOLTAGE BUSHING TERMINAL

[75] Inventors: James J. Seaquist, Birmingham; Elred R. Harmon, Pell City, both of Ala.

[73] Assignee: Square D Company, Palatine, Ill.

[21] Appl. No.: 409,202

[22] Filed: Aug. 18, 1982

[51] Int. Cl.[4] ..... H01R 13/627

[52] U.S. Cl. ..... 439/361; 439/806

[58] Field of Search ..... 339/272, 263 L, 264 L, 339/266

[56] References Cited

U.S. PATENT DOCUMENTS

| | | | |
|---|---|---|---|
| 1,278,013 | 9/1918 | Reed | 339/266 R |
| 1,420,790 | 6/1922 | Varney | 339/263 L |
| 1,798,815 | 3/1931 | Shepard | 339/266 L |
| 1,809,774 | 6/1931 | Coates | 339/266 L |
| 2,046,247 | 6/1936 | Chandler | 339/263 L |
| 2,559,187 | 7/1951 | Clapp | 339/266 L |
| 2,887,669 | 5/1959 | Sylvester | 339/263 L |
| 3,736,550 | 5/1973 | Wallace | 339/272 R |
| 4,032,212 | 6/1977 | Faust et al. | 339/263 L |

*Primary Examiner*—Eugene F. Desmond
*Assistant Examiner*—David Pirlot
*Attorney, Agent, or Firm*—Steve A. Litchfield; Thomas B. Lindgren; Richard T. Guttman

[57] ABSTRACT

An electrical terminal includes first and second members having elongated complementary arcuate surfaces thereon movable toward and away from each other by a clamping member. The second member is pivotally supported at one end on the first member and is configured so that different diameter conductors can be securely clamped between the arcuate surfaces.

9 Claims, 1 Drawing Sheet

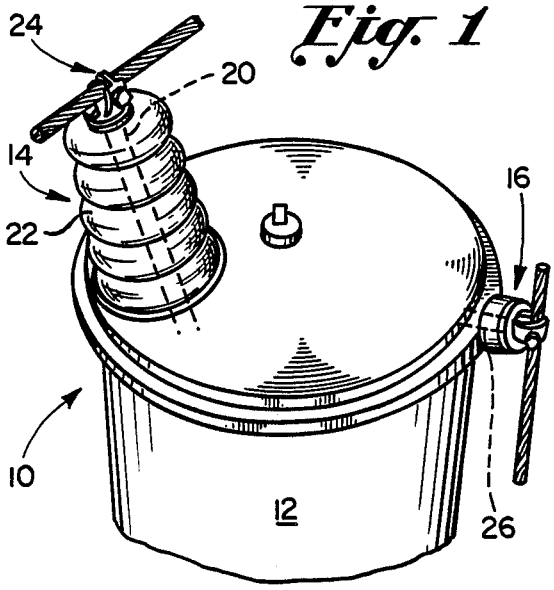
Fig. 1
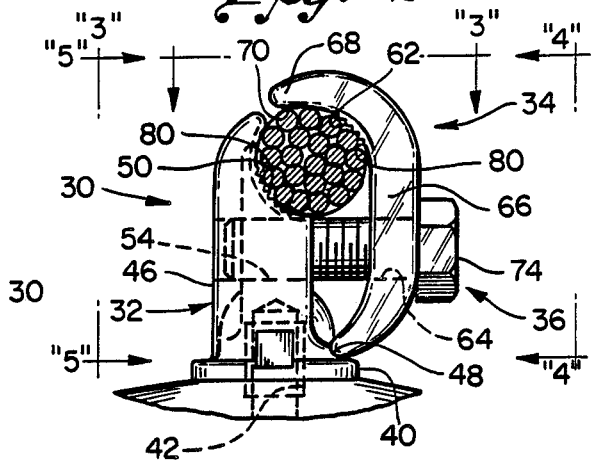
Fig. 2
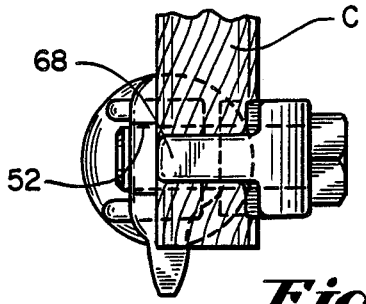
Fig. 3
Fig. 4
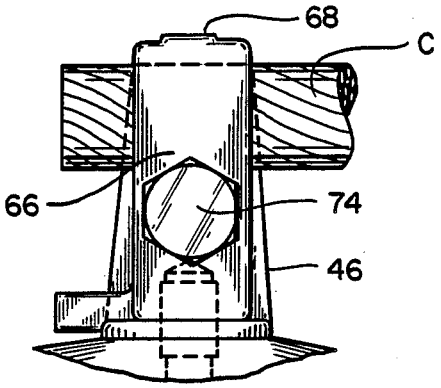
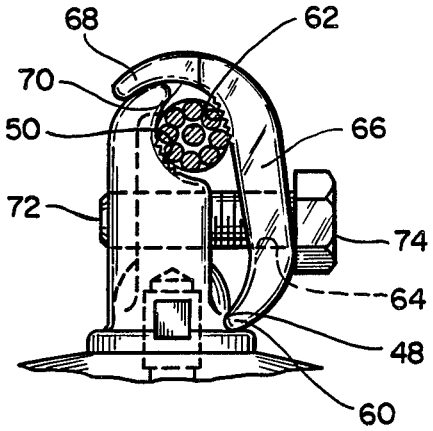
Fig. 6
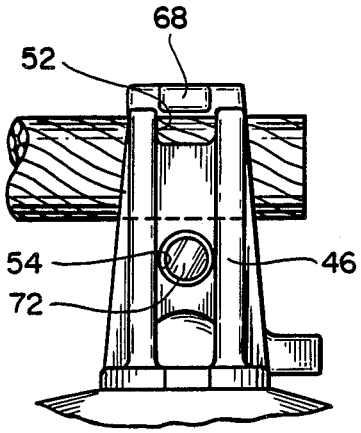
Fig. 5

LOW VOLTAGE BUSHING TERMINAL

TECHNICAL FIELD

The present invention relates generally to an electrical connector and, more specifically, to a terminal connector that is used in connection with connecting conductors to electrical equipment, such as transformers, regulators and cutouts.

BACKGROUND PRIOR ART

Many types of electrical connectors have been proposed and used for establishing contact with a wire or conductor. One area where such electrical contact is necessary is in a transformer which receives power from a high voltage source through a conductor, reduces the input to a low voltage output and applies this low voltage output to a low voltage conductor.

Such transformers have been in existence for a number of years and are commonly mounted on poles which also support the high voltage conductors. The high voltage conductors are connected to an input to the transformer through a terminal connection, while the low voltage output is connected to the second conductor through a further electrical connection.

For years the only acceptable type of connector that has been utilized in connecting the conductors to electrical equipment is a conventional eye-bolt connection. Such eye-bolt connection consists of a conventional eye-bolt that is usually a casting with an eye or opening at one end with a threaded connection at the free end. The eye-bolt is then supported on a base and a conductor is threaded through the eye of the bolt. A conventional nut is then utilized to clamp the conductor between the inner surface of the eye-bolt and an adjacent surface of the base.

While such a connection has been used for many years, certain inherent drawbacks are characteristic in the eye-bolt connection. One of the major problems with such a connection is the fact that the conductor can easily be damaged during the tensioning process because the eye-bolt has essentially line contact with the peripheral surface of the conductor, and thereby can easily bite into the surface thereof. Another problem that has been noted with connectors of this type is that there is only a limited contact area between the eye-bolt and the conductor which can easily produce a malfunction, particularly when the electrical equipment is exposed to the environment.

While these two problems have been in existence for a number of years, the same type of connection is still virtually standard in the electrical equipment industry.

SUMMARY OF THE INVENTION

According to the present invention, a new and simplified clamp-type of electrical terminal has been developed which will increase the contact area between the conductive surface of the clamp and the conductor. The improved design is extremely compact in nature, allowing the terminal to be positioned closer to the other electrical components and uses substantially less material.

More specifically, the low voltage bushing terminal of the present invention consists of a first member that has a base and a main body extending above the base. The main body has an arcuate exposed surface for engagement with a conductor and has a recess spaced from the surface that defines a pivot axis. A clamping mechanism is pivotally supported on the pivot axis and has a generally complementary arcuate exposed surface aligned with the exposed surface on the main body with pivoting means between the body and the member for moving the exposed surfaces toward each other to grip a conductor.

In the specific embodiment illustrated, the first member has a small circular base with a threaded bore extending from a surface of the base for mounting onto a conductive member with the main body extending above the base and having a generally arcuate surface at the opposite end thereof. An elongated recess is located at the base and extends generally parallel to the elongated arcuate surface, while the clamping member has an elongated body that has one end pivotally received into the recess with the opposite end having the complementary surface thereon generally aligned with the surface on the main body. The main body has a threaded opening between opposite ends thereof, and the clamping member has an unthreaded opening between opposite ends with a threaded fastener received through the unthreaded opening into the threaded opening to accommodate moving the complementary surfaces towards each other to clamp a conductor therebetween.

In the preferred version of the invention, the elongated clamping member has a reduced portion extending beyond the arcuate exposed surface which is received into a slot on the opposite end of the main body and the complementary surfaces are serrated to reduce the possibility of the conductor being pulled from the terminal after being properly aligned.

The elongated exposed surfaces of the terminal substantially increases the contact area between the conductor and the terminal to reduce the possibility of having a malfunctioning connection between a conductor and the power component, such as a transformer.

BRIEF DESCRIPTION OF SEVERAL VIEWS OF DRAWINGS

FIG. 1 of the drawings shows an electrical component having the electrical connector of the present invention incorporated therein;

FIG. 2 is a side elevation view of the electrical connector;

FIG. 3 is a top plan view of the electric connector, as viewed along line 3—3 of FIG. 2;

FIG. 4 is a side view of the electrical connector, as viewed along line 4—4 of FIG. 2;

FIG. 5 is a side view of the electrical connector as viewed along line 5—5 of FIG. 2; and, FIG. 6 is a view similar to FIG. 4 showing a smaller diameter conductor.

DETAILED DESCRIPTION

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

FIG. 1 of the drawings discloses an electrical component, such as a transformer 10, to which the present invention is specifically adapted. Transformer 10 includes a main body 12 that has a high voltage input 14 and a low voltage output 16 with the main body or housing 12 embodying the components that convert the incoming power from a high voltage to a low voltage.

Usually the high voltage input 14 is in the form of a conductive metal rod 20 that extends through the center of an insulator 22 and has a terminal connector 24 at the outer free end thereof for connection of the high voltage conductor thereto.

Likewise, the low voltage output is in the form of a conductive rod 26 which has an electrical terminal 30 supported on the outer end thereof. The electrical terminal or bushing 30 is the subject matter of the present invention and will now be described in detail with reference to the remainder of the Figures.

The electrical connector or bushing terminal 30 includes a first member 32 and a second member 34 with a threaded member 36 interconnecting the two members.

The first member 32 has a substantially circular base 40 which has an internally-threaded bore 42 extending from a flat surface thereof and terminates at a point spaced inwardly from the surface. First member 32 has an elongated generally rectangular main body 46 extending from base 40 and has an elongated support surface 48 in the form of an elongated recess at one end thereof. Rectangular main body 46 has an elongated arcuate exposed surface 50 at an opposite end thereof and the elongated arcuate surface 50 has a common radius and spans an arc of approximately 90°. The outer free end of the elongated surface has a slot 52 extending from the opposite end, for a purpose that will be described later.

The main body 46 also has a threaded opening 54 extending between opposed surfaces and substantially centered between arcuate surface 50 and recess 48.

Second clamping member 34 is again substantially rectangular and has a generally radial exposed elongated surface 60 at one end thereof and a generally arcuate elongated surface 62 adjacent an opposite end thereof, which is generally complementary to the arcuate surface 50 and has a common radius therewith. A circular unthreaded opening 64, which is preferably slightly elongated, is located in a central portion 66 of second member 34 and is substantially equally spaced from opposite ends thereof. A reduced ear or integral extension 68 extends beyond arcuate surface 62 and has a width that is slightly less than the width of slot 52 in the first member 32.

As shown in FIG. 2, the inner, generally flat, surface 70 of reduced ear 68 extends substantially tangentially from one end of arcuate surface 62, for a purpose that will be described later. As noted in FIG. 6, the one end or arcuate end surface 60 of second member 34 and the elongated arcuate surface 62 are both laterally offset to the same side as the main central portion 66 having the opening 64 therein.

The third component of the electrical terminal is the threaded fastener 36 which can be a conventional screw that has a threaded circular portion 72 and an enlarged central head 74 at one end thereof.

In use of the electrical terminal or connector, the first member 32 is first threaded onto conductor 26 that forms part of the transformer 10 and a second member is loosely supported on the first member by threaded fastener 36 to produce a generally circular opening between complementary surfaces 50 and 62. A circular conductor (C) is then inserted between the two complementary surfaces and threaded fastener 36 is then utilized for moving the complementary surfaces towards each other to securely clamp conductor (C) between the complementary elongated arcuate surfaces. During such movement, the surface end 60 is pivotally supported in recess 48 and defines a pivot point or fulcrum point for the elongated second member 34.

If a smaller conductor is to be clamped, the components will assume the position illustrated in FIG. 6. In this instance, the elongated ear 70 is made of sufficient length so that it is received into slot 52 before the conductor (C) is securely clamped between the complementary surfaces to prevent any lateral relative movement of the elongated arcuate surfaces along the axis of the conductor (C). The elongated ear is also designed so that it can be received into the elongated slot a sufficient distance to accommodate conductors of different diameters. The elongated ear 68 will prevent the escape of strands of the conductor, when stranded conductor is used.

In all instances, having the opposite ends, namely surface end 60 and arcuate surface 62, laterally offset to one side of the center body portion 66 will allow a greater extent of movement of the arcuate surfaces toward and away from each other to accommodate the conductors of different sizes.

The respective arcuate surfaces have serrations or irregular surface 80 produced thereon to increase the gripping power of the electrical connector with respect to the conductor (C).

Of course, the clamping components are preferably formed of a conductive metal material, such as bronze alloy, while the threaded fastener 36 could be formed from a stainless steel material.

As can be appreciated from the above description, the present invention provides a unique, simplified fastener or bushing terminal that can be manufactured from a minimum amount of material and yet provide extended surface engagement between the conductive clamping members and the conductor being clamped therebetween. The extended surface contact of the arcuate surfaces 50 and 62 reduces the possibility of damage of the conductor by nicking or biting the conductive conductor.

It will also be appreciated that the invention is not limited to the environment illustrated. For example, the invention is specifically disclosed in connection for a use with or as a low voltage outlet of a transformer. However, the connector or terminal could be used for any other purpose wherein a savings in materials is desired and it is necessary to place the components in a restricted environment.

We claim:

1. A clamp-type electrical terminal comprising a main body having an arcuate exposed surface for engagment with a conductor, means defining a pivot axis on said main body spaced from said exposed surface, a clamping member having one end supported on said pivot axis and a second end having a generally complementary arcuate exposed surface spaced from said one end and disposed opposite the arcuate exposed surface of the main body, pivoting means between said body and said member for moving said exposed surfaces towards each other to grip a conductor, said second end of said clamping member having a reduced ear extending therefrom, said reduced ear integral with said second end and said main body having a slot located therein for receiving the reduced ear of the clamping member.

2. A clamp-type electrical terminal as defined in claim 1 in which said pivoting means includes a threaded fastener with said body having a threaded opening receiving said fastener and said clamping member having an aligned opening receiving said fastener.

3. A clamp-type electrical terminal as defined in claim 1 in which said arcuate exposed surfaces of the main body and the clamping member span an arc and have serrations thereon.

4. A clamp-type electrical terminal as defined in claim 1 in which said main body has a base with a threaded mounting opening extending perpendicular to said threaded opening for mounting on an insulator.

5. A clamp-type electrical terminal as defined in claim 1 in which said reduced ear has an inner surface extending substantially tangential to one end of said arcuate exposed surface on said clamping member.

6. A clamp-type electrical terminal as defined in claim 1 in which said arcuate exposed surfaces have a common radius.

7. A low voltage bushing terminal including a conductive main body having an arcuate conductor engaging surface and a support surface spaced from said conductor engaging surface with a threaded opening between said surfaces, a conductive clamping member having two opposite ends, one end engaging said support surface and a complementary arcuate conductor engaging surface adjacent an opposte end with an opening between said opposite ends, a threaded fastener extending through said opening in said clamping member and received into said threaded opening, said main body having a slot therein adjacent said arcuate conductor engaging surface and said complementary arcuate conductor engaging surface of said clamping member having an extension therefrom integral therewith and aligned with said slot, such that said extension is receivable into said slot as said threaded fastener is tightened.

8. A low voltage bushing terminal comprising a conductive elongated first member having a threaded bore on one end, said one end including a recess therein, and an arcuate surface on an opposite end, said arcuate surface spanning an arc with a common radius, said first member having a threaded opening extending substantially perpendicular to said threaded bore between said opposite ends, and an elongated second member having one end received into said recess and pivotally supported therein, said second member having a complementary arcuate surface spanning an arc on a second, opposite end and having said common radius, said second member having an unthreaded opening axially aligned with said threaded opening and being slightly larger in diameter, and a threaded fastener extending through said unthreaded opening and received into said threaded opening so that rotation of said fastener will move said arcuate surfaces towards each other with said recess defining a fulcrum point for pivotal movement of said second member on said first member, said second member having an integral extension on said second, opposite end and said first member having a slot for receiving said extension during movement of said arcuate surfaces towards each other.

9. A low voltage bushing terminal as defined in claims 7 or 8 in which said one end and said arcuate surface of said second member are laterally offset to one side of a central portion having said unthreaded opening of the second member.

* * * * *